US011110732B2

(12) United States Patent
Mercier

(10) Patent No.: US 11,110,732 B2
(45) Date of Patent: Sep. 7, 2021

(54) LUMBER STACK MARKING MACHINE AND METHODS OF APPLYING MARKINGS TO LUMBER STACKS

(71) Applicant: Signode Packaging Group Canada ULC, Markham (CA)

(72) Inventor: Sebastien Mercier, St. Lambert de Lauzon (CA)

(73) Assignee: Signode Canada ULC, Halifax (CA)

( * ) Notice: Subject to any disclaimer, the term of this patent is extended or adjusted under 35 U.S.C. 154(b) by 133 days.

(21) Appl. No.: 16/280,270

(22) Filed: Feb. 20, 2019

(65) Prior Publication Data

US 2019/0270327 A1 Sep. 5, 2019

(30) Foreign Application Priority Data

Mar. 2, 2018 (CA) ..... 2997069

(51) Int. Cl.

| | |
|---|---|
| ***B41M 5/00*** | (2006.01) |
| ***B41J 2/045*** | (2006.01) |
| ***B41J 3/00*** | (2006.01) |
| ***B41J 3/407*** | (2006.01) |
| ***B05C 1/08*** | (2006.01) |
| ***B05B 13/04*** | (2006.01) |

(52) U.S. Cl.

CPC ..... *B41M 5/0076* (2013.01); *B05B 13/0431* (2013.01); *B05C 1/0873* (2013.01); *B41J 2/04586* (2013.01); *B41J 3/00* (2013.01); *B41J 3/4073* (2013.01); *B41M 5/0047* (2013.01)

(58) Field of Classification Search

CPC . B41M 5/0076; B05B 13/0431; B41J 3/4073; B41J 2/04586

See application file for complete search history.

(56) References Cited

U.S. PATENT DOCUMENTS

| | | | |
|---|---|---|---|
| 3,566,936 A | 3/1971 | Golick et al. | |
| 4,201,506 A | 5/1980 | Rysti | |
| 4,392,204 A | 7/1983 | Prim et al. | |
| 5,292,048 A | 3/1994 | Vanderwiel | |
| 5,775,397 A | 7/1998 | Lippincott | |
| 6,174,036 B1 * | 1/2001 | Aman | B41J 3/4073 347/2 |
| 6,925,931 B2 | 8/2005 | Korhonen | |
| 7,003,898 B2 | 2/2006 | Aaron | |
| 7,826,921 B2 | 11/2010 | Kellam et al. | |

(Continued)

FOREIGN PATENT DOCUMENTS

| | | |
|---|---|---|
| EP | 2065149 A1 | 6/2009 |
| EP | 2196278 A1 | 6/2010 |
| JP | 6259796 B2 | 12/2017 |

OTHER PUBLICATIONS

Canadian Patent Office, "Examination Report" from co-pending Canadian Patent Application No. 2,997,069 (6 pages), dated Mar. 26, 2019.

(Continued)

*Primary Examiner* — Dah-Wei D. Yuan
*Assistant Examiner* — Stephen A Kitt
(74) *Attorney, Agent, or Firm* — Neal, Gerber & Eisenberg LLP

(57) ABSTRACT

Various embodiments of the present disclosure provide lumber stack marking machines and methods of applying marking sets to lumber stacks.

8 Claims, 13 Drawing Sheets

(56) References Cited

U.S. PATENT DOCUMENTS

| | | | | |
|---|---|---|---|---|
| 8,516,958 | B2 | 8/2013 | Kennedy et al. | |
| 2015/0042716 | A1 | 2/2015 | Beier et al. | |
| 2015/0225104 | A1* | 8/2015 | Reed | B65B 61/26 347/110 |

OTHER PUBLICATIONS

REA JET LK32 , "Large Character Ink Jet Printing System", Traditional method of horizontal printing, available prior to Mar. 2, 2018 (1 page).
Tebulo, "Robotic Stenciling" Tebulo Industrial Robotics, available prior to Mar. 2, 2018 (1 page).

* cited by examiner

LUMBER STACK MARKING MACHINE AND METHODS OF APPLYING MARKINGS TO LUMBER STACKS

PRIORITY

This application claims priority to and the benefit of Canadian Patent Application No. 2,997,069, filed Mar. 2, 2018, the entire contents of which are incorporated herein by reference.

FIELD

The present disclosure relates to lumber stack marking machines and methods of applying markings to lumber stacks.

BACKGROUND

A rough-sawn lumber stack typically includes multiple rows of lumber stacked atop one another. The rows of lumber are vertically separated by transversely extending stickers in part to facilitate lumber drying processes such as kiln drying and air drying. For purposes of this disclosure, lumber includes but is not limited to beams, planks, and the like.

FIGS. 1, 2, and 3 illustrate an example rough-sawn lumber stack 10. This lumber stack 10 includes: (1) one hundred sixty-eight individual pieces of lumber stacked in twenty-one rows 12*a*-12*u* and eight columns 13*a*-13*h*; (2) eighty transversely extending stickers that separate the twenty-one rows of lumber 12*a*-12*u* and that are formed in twenty rows 14*a*-14*t* and four columns 15*a*-15*d*; and (3) two transversely extending tensioned straps 16*a* and 16*b* that hold the lumber together. In this illustrated example lumber stack 10, each row of lumber 12*a*-12*u* includes eight individual pieces of lumber that are all of substantially the same size (i.e., substantially the same length, width, and height). In this illustrated example lumber stack 10, each row of stickers 14*a*-14*t* includes four individual spaced apart stickers that are all of substantially the same size (i.e., substantially the same length, width, and height). In this illustrated example lumber stack 10, each column of stickers 15*a*-15*d* includes twenty spaced apart stickers, such as stickers 14*a*1-14*t*1. The rows and columns of lumber of this lumber stack 10 are substantially aligned and thus generally form opposing outer front and back side walls 20 and 22, two opposing outer end walls 24 and 26, an outer top wall 28, and an outer bottom wall 30. In this illustrated lumber stack 10, the front and back side walls 20 are of a greater length than the outer end walls 24 and 26. In this illustrated lumber stack 10, each sticker is longer than the distance between the front and back side walls 20 and 22 and thus extends beyond each of the front and back side walls 20 and 22 as generally shown in FIG. 3. In other known lumber stacks, each sticker is longer than the distance between the front and back side walls but only extends beyond one of the front and back side walls. The stickers are often not perfectly aligned from back to front, and thus often extend at different distances beyond the opposing front and back side walls 20 and 22 as generally shown in FIG. 3. In certain instances, a sticker may be substantially out of alignment such that one end of the sticker does not extend outwardly from one of the front and back side walls 20 and 22, and the other end of the sticker extends substantially outwardly from the other one of the front and back side walls. The sticker sizes and shapes may vary, and the illustrated example stickers are not meant to include or show all such sticker variations.

Lumber stacks like the lumber stack 10 must be marked with various markings that enable one to identify the dimensions of the lumber stack, track the lumber stack, identify the species of the lumber in the lumber stack, identify the date the lumber stack was formed, control manufacturing processes, and/or control inventory.

In one known way of marking a lumber stack, a person spray paints by hand a horizontal marking set including two or more horizontally aligned markings (such as numbers or letters) on one or more of the front, back, and end walls 20, 22, 24, and 26 of the lumber stack 10. This is time consuming, inefficient, and often results in sloppy and possibly unreadable markings. FIG. 1 shows an example of a sloppy horizontally extending marking (not labeled).

One can also use a marking machine to apply a horizontal marking set to a lumber stack. One problem with these known marking machines is that they are not easily adaptable to lumber stacks of different sizes and must be reconfigured whenever the size of consecutive lumber stacks changes, thus lowering throughput. Additionally, stickers that extend too far from the to-be-marked surface of the lumber stack occasionally interfere with these known marking machines, which causes misapplication of the horizontal marking set or damage to the marking machine.

SUMMARY

Various embodiments of the present disclosure provide lumber stack marking machines and methods of applying markings of a marking set to lumber stacks.

Various example embodiments of the present disclosure provide a method of applying a vertical marking set to a lumber stack, wherein the method includes moving the lumber stack adjacent to a lumber stack marking machine, moving a marking applicator assembly of the lumber stack marking machine relative to the lumber stack from a rest position to a marking position, applying, by the marking applicator assembly, a first marking and a second marking of the vertical marking set to an outer wall of the lumber stack, wherein the second marking is below the first marking, and moving the marking applicator assembly from the marking position to the rest position.

Various other example embodiments of the present disclosure provide a lumber stack marking machine including a frame, an arm assembly connected to the frame, an actuator assembly connected to the frame and operatively connected to the arm assembly to move the arm assembly, a marking applicator assembly connected to the arm assembly, and a controller. The controller is operatively connected to the actuator assembly to control the actuator assembly to move the arm assembly and the marking applicator assembly from a rest position to a marking position and to control the marking applicator to, when in the marking position, apply a first marking of a marking set to an outer wall of the lumber stack and apply a second marking of the marking set to the outer wall of the lumber stack below the first marking.

DETAILED DESCRIPTION

Figure 1:
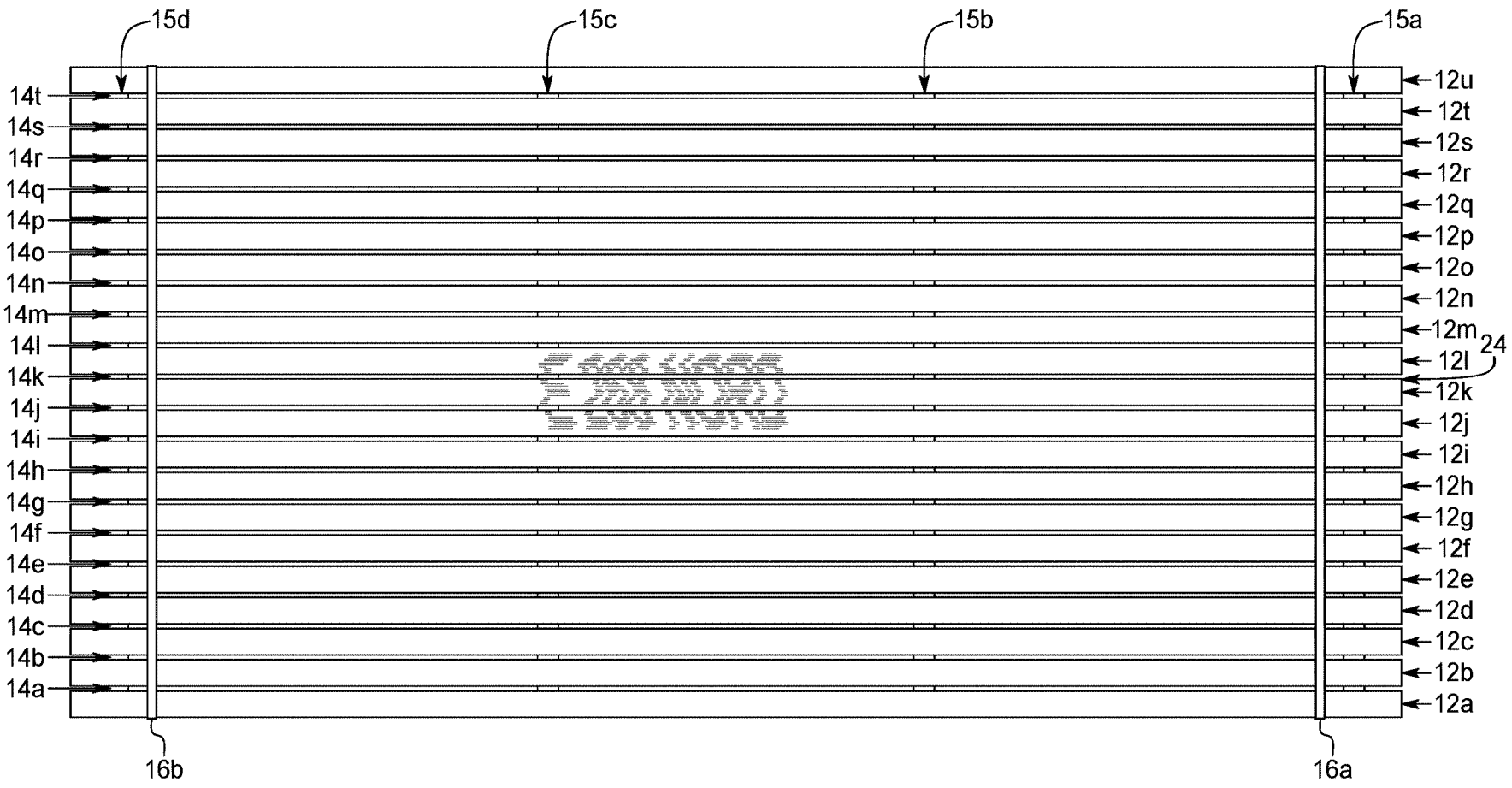
FIG. 1 is a side view of a known lumber stack with a known horizontally extending marking set.
Figure 2:
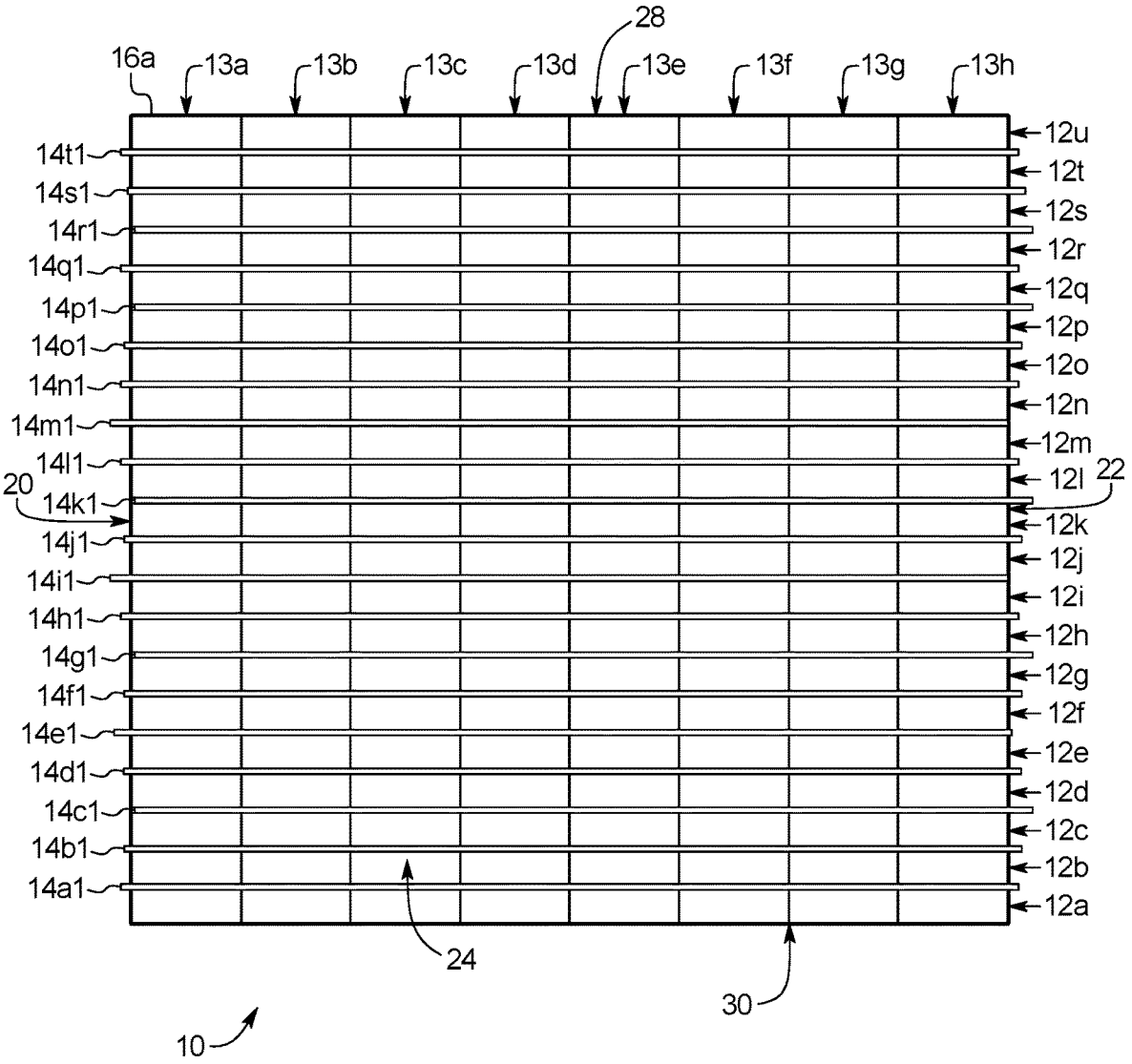
FIG. 2 is an end view of the lumber stack of FIG. 1.
Figure 3:
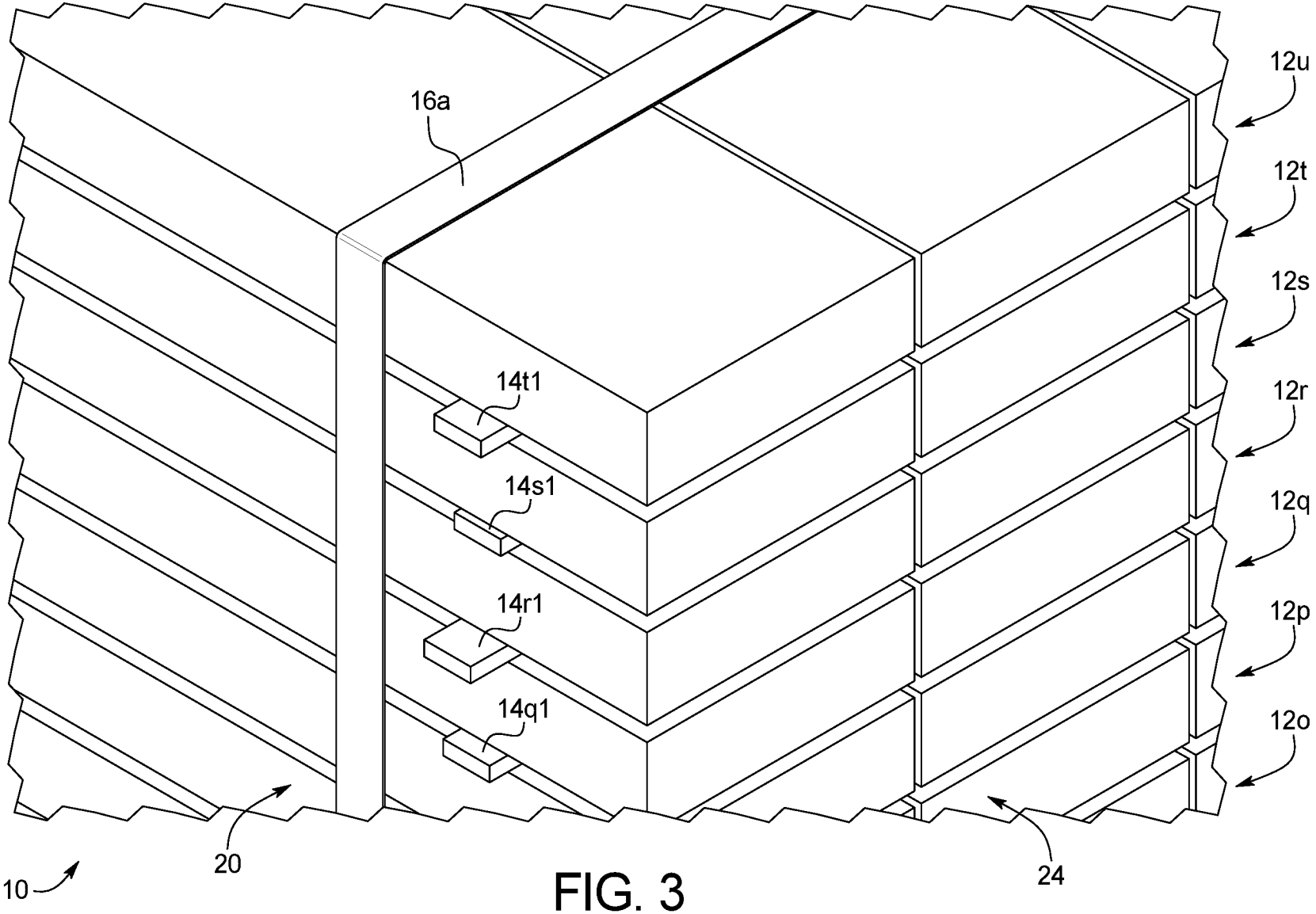
FIG. 3 is an enlarged fragmentary perspective view of an upper corner of the lumber stack of FIG. 1.

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, and the like, are not intended to be limited to direct mounting methods but should be interpreted broadly to include indirect and operably coupled, mounted, connected and like mounting methods. This specification is intended to be taken as a whole and interpreted in accordance with the principles of the present disclosure and as understood by one of ordinary skill in the art.

Example Methods of Applying Markings of a Marking Set to Lumber Stacks

Figure 4:
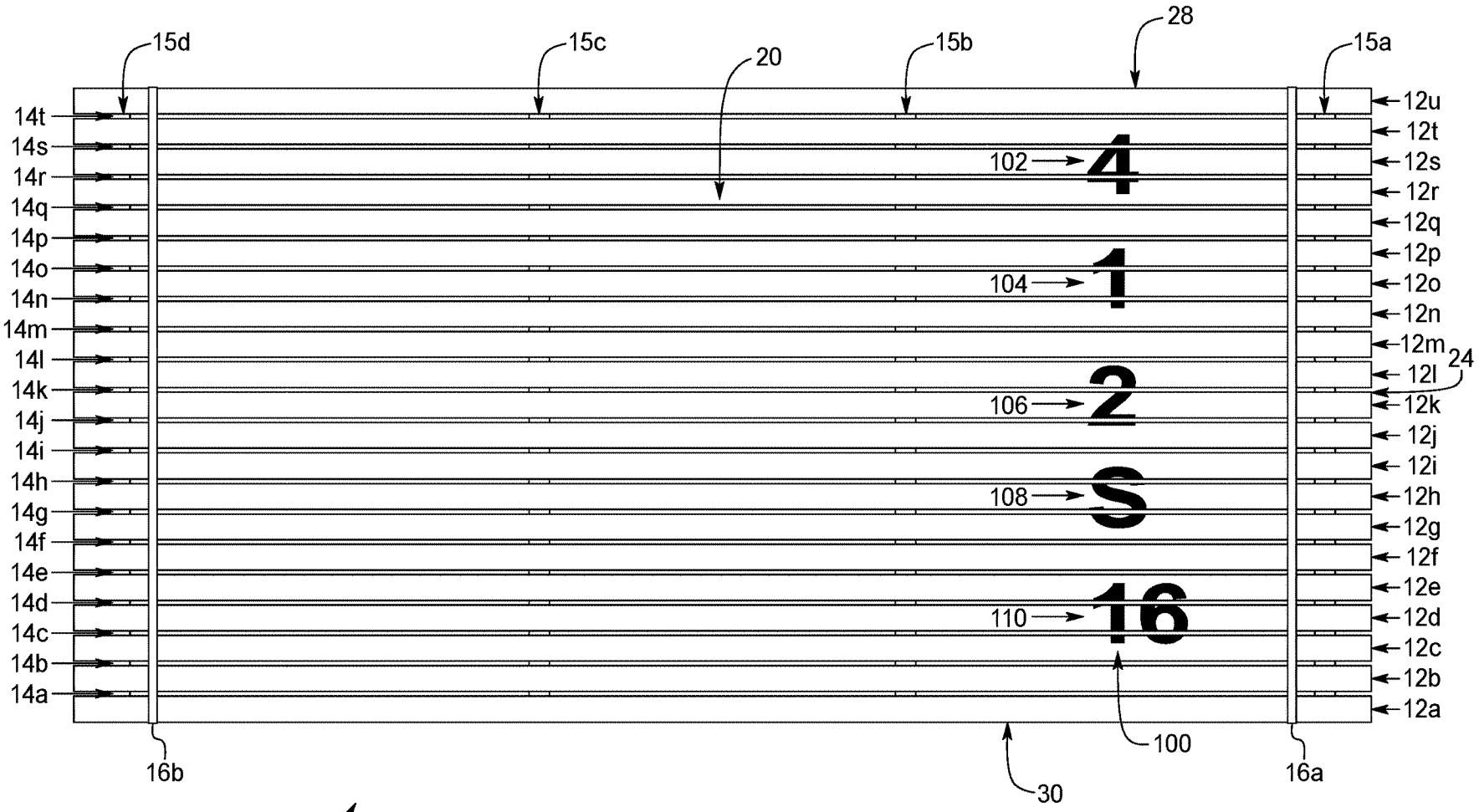
FIG. 4 is a side view of a lumber stack having an example vertical marking set of one example embodiment of the present disclosure.
Figure 5:
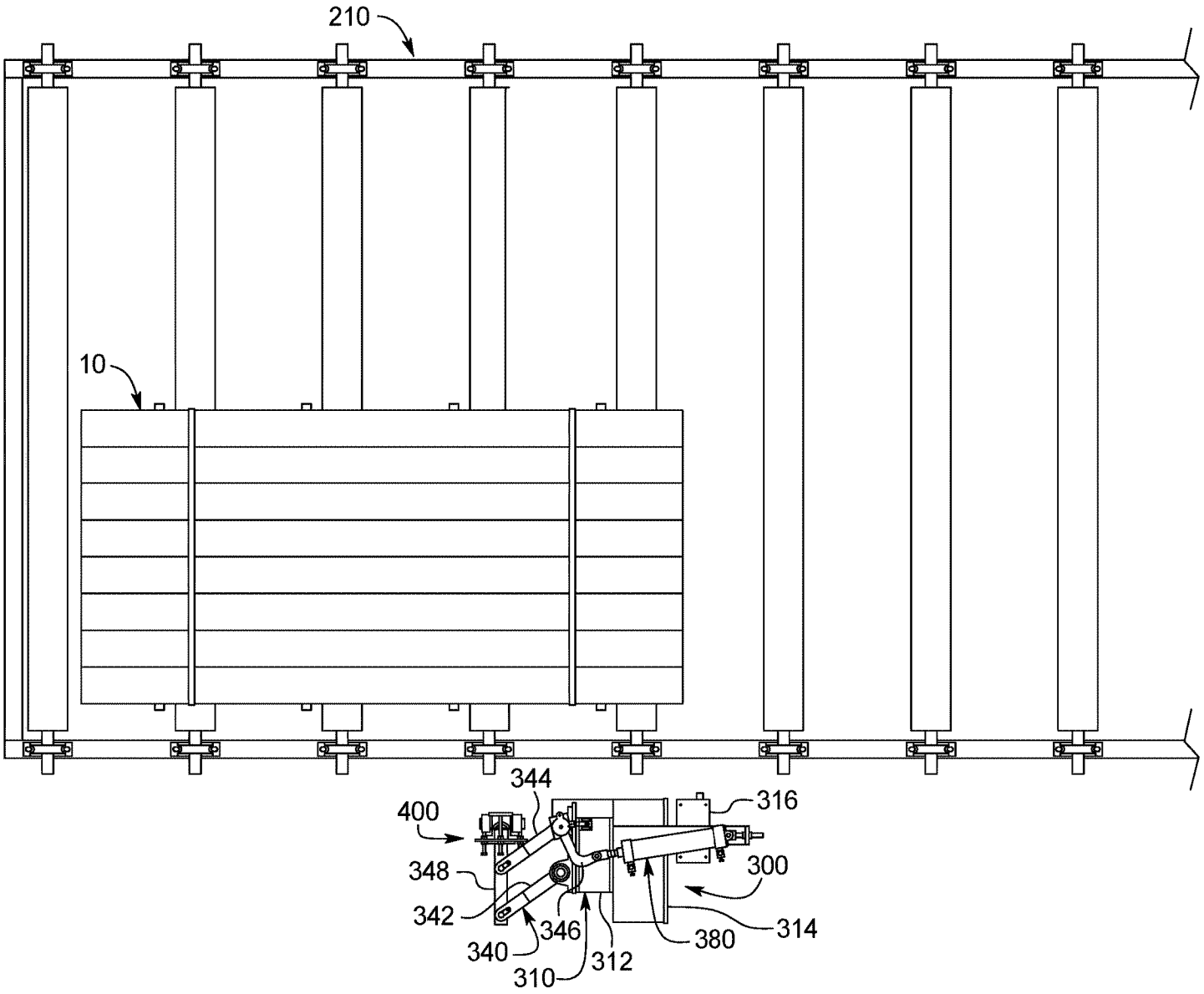
FIG. 5 is a top diagrammatic view of a lumber stack longitudinally positioned on and movable on a lumber stack conveyor apparatus (shown in fragmentary) and a lumber stack marking machine of one example embodiment of the present disclosure positioned adjacent to the lumber stack conveyor apparatus and configured to apply vertically extending markings of a marking set to a front side wall of the lumber stack.

FIG. 4 illustrates an example lumber stack 10 that has been marked by using one of several different example methods (described below) of applying a vertical marking set to a lumber stack.

The terms vertical marking set (and vertically extending markings) in accordance with the present disclosure is meant to include: (1) two or more markings that intersect the same vertical or substantially vertical axis (relative to the lumber stack); (2) two or more markings in which one of the markings is at least partially below a bottom of another one of the markings; (3) two or more markings in which one of the markings is entirely below a bottom of another one of the markings (put differently, two or markings in which no horizontal line that passes through one of the markings intersects any horizontal line that passes through the other one of the markings); or (4) combinations of (1)-(3).

The lumber stack 10 is described above. The front wall 20 has a vertical marking set 100 including: (1) individual marking "4" indicated by element number 102; (2) individual marking "1" indicated by element number 104 and positioned below the marking 102; (3) individual marking "2" indicated by element number 106 and positioned below the marking 104; (4) individual marking "S" indicated by element number 108 and positioned below the marking 106; and (5) individual marking "16" indicated by element number 110 and positioned below the marking 108. More specifically, in this example embodiment: (1) the marking 104 is completely below the marking 102 such that no horizontal lines passing through the marking 104 intersect any horizontal lines passing through the marking 102; (2) the marking 106 is completely below the marking 104 such that no horizontal lines passing through the marking 106 intersect any horizontal lines passing through the marking 104; (3) the marking 108 is completely below the marking 106 such that no horizontal lines passing through the marking 108 intersect any horizontal lines passing through the marking 106; and (4) the marking 110 is completely below the marking 108 such that no horizontal lines passing through the marking 108 intersect any horizontal lines passing through the marking 110. Additionally, the markings 102-110 each intersect the same vertical axis (not labeled). This vertical marking set 100 including the markings 102, 104, 106, 108, and 110 is positioned on the surface of the side wall 20 between sticker columns 15*a* and 15*b*.

One example method of applying the vertical marking set 100 to the lumber stack 10 is a top-down method. In this example method, each marking is applied below the prior-applied marking (i.e., from top to bottom). This example method includes: (1) positioning a marking head adjacent to the side wall 20 of the lumber stack 10 between sticker columns 15*a* and 15*b* and a first predetermined distance D1 below the top wall 28 of the lumber stack 10; (2) causing the marking head to apply the marking 102 (i.e., the "4") to the side wall 20 of the lumber stack 10 between sticker columns 15*a* and 15*b* and in a first predetermined area DA1 below the top wall 28 of the lumber stack 10; (3) positioning the marking head adjacent to the side wall 20 of the lumber stack 10 between sticker columns 15*a* and 15*b* and a second predetermined distance D2 below the top wall 28 of the lumber stack 10; (4) causing the marking head to apply marking 104 (i.e., the "1") to the side wall 20 of the lumber stack 10 between the sticker columns 15*a* and 15*b* and in a second predetermined area DA2 below the top wall 28 of the lumber stack 10; (5) positioning the marking head adjacent to the side wall 20 of the lumber stack 10 between sticker columns 15*a* and 15*b* and a third predetermined distance D3 below the top wall 28 of the lumber stack 10; (6) causing the marking head to apply marking 106 (i.e., the "2") to the side wall 20 of the lumber stack 10 between sticker columns 15*a* and 15*b* and in a third predetermined area DA3 below the top wall 28 of the lumber stack 10; (7) positioning the marking head adjacent to the side wall 20 of the lumber stack 10 between sticker columns 15*a* and 15*b* and a fourth predetermined distance D4 below the top wall 28 of the lumber stack 10; (8) causing the marking head to apply marking 108 (i.e., the "S") to the side wall 20 of the lumber stack 10 between two of the sticker columns 15*a* and 15*b* and in a fourth predetermined area DA4 below the top wall 28 of the lumber stack 10; (9) positioning the marking head adjacent to the side wall 20 of the lumber stack 10 between sticker columns 15*a* and 15*b* and a fifth predetermined distance D5 below the top wall 28 of the lumber stack 10; and (10) causing the marking head to apply marking 110 (i.e., the "16") to the side wall 20 of the lumber stack 10 between the sticker columns 15*a* and 15*b* and in a fifth predetermined area DA5 below the top wall 28 of the lumber stack 10. In this example method of the present disclosure: (1) D1<D2; (2) D2<D3; (3) D3<D4; and (4) D4<D5. In this example method of the present disclosure: (1) DA2 is below DA1; (2) DA3 is below DA3; (3) DA3 is below DA4; and (4) DA5 is below DA4. In this example method of the present disclosure: (1) marking 104 extends along a vertical axis below marking 102; (2) marking 106 extends along a vertical axis below marking 104; (3) marking 108 extends along a vertical axis below marking 106; and (4) marking 110 extends along a vertical axis below marking 108. In this illustrated example method, each subsequent marking is applied below the prior applied marking of the marking set 100.

Another example method of applying this example vertically extending marking set 100 to the lumber stack 10 is a bottom-up method. In this alternative example method of the present disclosure, each marking is applied above the prior applied marking (i.e., from bottom to top). In this alternative example method of the present disclosure even though the order of application has changed: (1) marking 104 is below marking 102; (2) marking 106 is below marking 104; (3) marking 108 is below marking 106; and (4) marking 110 is below marking 108. Thus, in this alternative example method of the present disclosure even though the order of application has changed: (1) D1<D2; (2) D2<D3; (3) D3<D4; and (4) D4<D5. Likewise, in this alternative example method of the present disclosure even though the order of application has changed: (1) DA1 is above DA2; (2) DA2 is above DA3; (3) DA3 is above DA4; and (4) DA4 is above DA5. In a further alternative example method of the present disclosure, each marking is applied in alternative order (rather than top down or bottom up).

In these example embodiments, the method includes applying the five markings 102, 104, 106, 108, and 110 one below the other and between two of the sticker columns 15*a* and 15*b*. The quantity of markings in the vertical marking set 100 may vary in accordance with the present disclosure, and specifically may be more or less than five markings.

In this illustrated example embodiment, the method includes applying a single vertical marking set 100. In other embodiments, the method includes applying multiple vertical marking sets, as further described below. Thus, the quantity of vertical marking sets may vary in accordance with the present disclosure.

In various embodiments in which the method includes applying multiple vertical marking sets on the lumber stack, the method includes alternating the direction of application of the individual markings of the respective marking sets. For example, in one method that includes two vertical marking sets, this method includes applying the markings of the first vertical marking set from top to bottom and the markings of the second vertical marking set from bottom to top. Alternatively, in another example method that includes two vertical marking sets, the method includes applying the markings of the first vertical marking set from bottom to top and the markings of the second vertical marking set from top to bottom. These methods minimize the movements of the marking heads needed to apply the markings of the marking sets. Alternatively, in another example method that includes two vertical marking sets, this method includes applying the markings of the first vertical marking set from top to bottom and the markings of the second vertical marking set from top to bottom. Alternatively, in another example method that includes two vertical marking sets, this method includes applying the markings of the first vertical marking set from bottom to top and the markings of the second vertical marking set from bottom to top.

In various embodiments, the method includes starting to apply the markings at the bottom or top of the lumber stack based on where the marking head applied the last marking to the previous lumber stack. In other words, the method includes starting at the top if the previous marking applied was a top most marking of a vertical marking set, and starting at the bottom if the previous marking applied was a bottom most marking of the vertical marking set. This method minimizes the movements of the marking head needed to apply the markings of the marking sets.

In the illustrated example embodiment of FIG. 4, the method includes applying markings in one vertical marking set 100 between the first set of first two sticker columns 15*a* and 15*b*. The position of the vertical marking set between sticker columns may vary in accordance with the present disclosure, and specifically may alternatively be between another set of stickers columns of the lumber stack. In further alternative embodiments of the present disclosure, multiple vertical marking sets are respectively positioned between multiple sets of sticker columns.

In various of these example embodiments, the methods of the present disclosure prevent the stickers from interfering with markings applied to the lumber stack as further described below.

More specifically, in various embodiments of the present disclosure, the method includes moving a marking applicator assembly toward the lumber stack from a rest position to a marking position between the stickers of the lumber stack for applying one or more vertical markings to an outer wall of the lumber stack. In various such embodiments, this movement toward the lumber stack includes one or more horizontal or substantially horizontal movements.

This method then includes, for each desired vertical marking set on the side wall of the lumber stack, moving part of a marking applicator assembly substantially vertically along the lumber stack between the stickers of the lumber stack and applying that marking set to the lumber stack during this substantially vertical movement. This method then includes moving the marking applicator assembly away from the marking position to a rest position. In various such embodiments, this movement away from the lumber stack includes one or more horizontal or substantially horizontal movements.

The methods of the present disclosure of applying one or more marking sets on an outer front or back wall of the lumber stack can be employed when the lumber stack is longitudinally positioned on a conveyor and moves longitudinally on the conveyor the lumber stack. This longitudinal movement is generally illustrated in FIGS. 5, 6, 7, and 8, in which: (1) the front and back walls 20 and 22 of the lumber stack 10 extend in the direction of movement of the lumber stack on the conveyor; and (2) the end walls 24 and 26 of the lumber stack 10 extend transverse to the direction of movement of the lumber stack on the conveyor.

Figure 10:
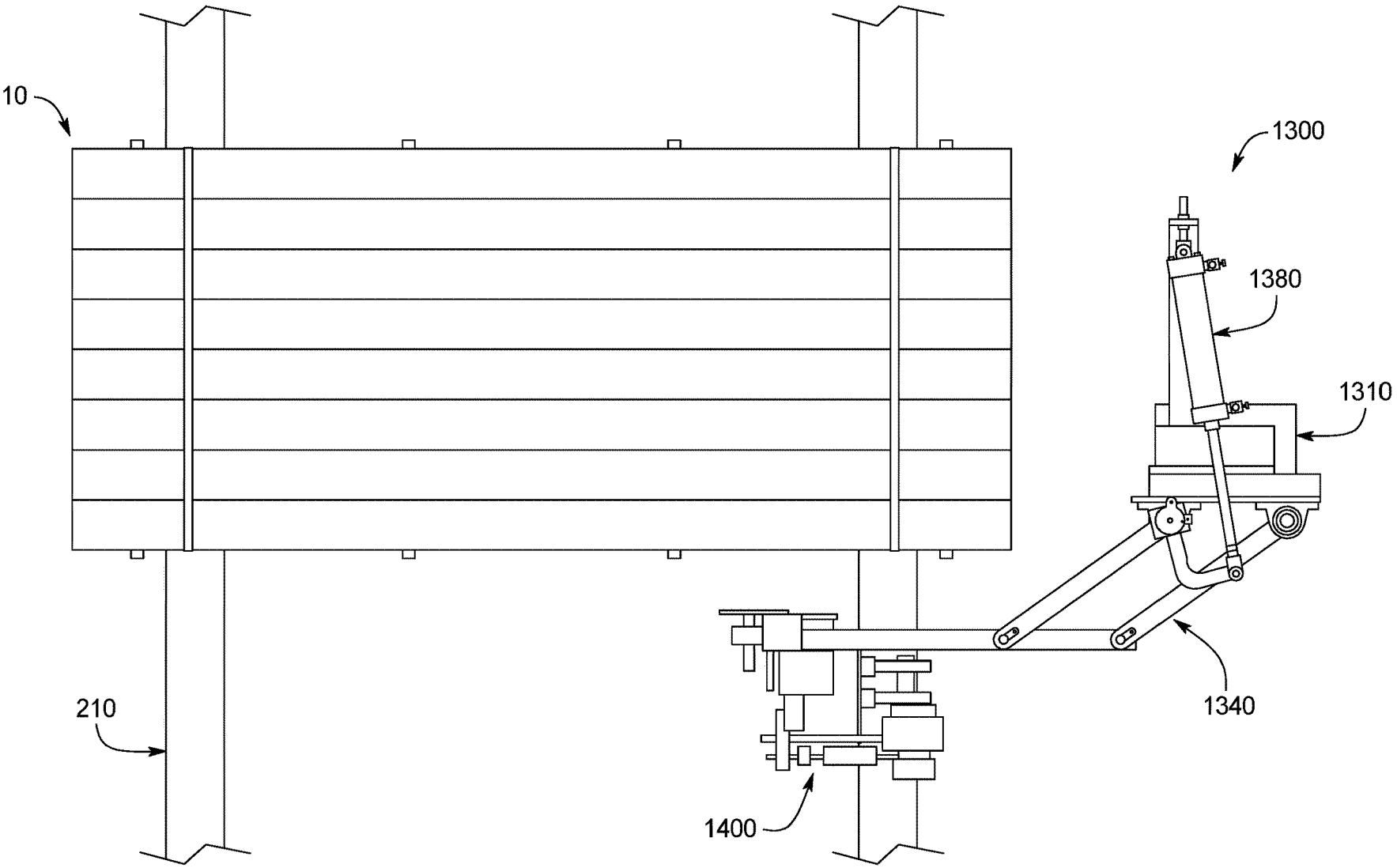
FIG. 10 is a top diagrammatic view of a lumber stack transversely positioned on and moveable on a lumber stack conveyor apparatus (shown in fragmentary) and an alternative example embodiment of the lumber stack marking machine of the present disclosure positioned adjacent to the lumber stack conveyor apparatus and configured to apply vertically extending markings of a marking set to a front side wall of the transversely positioned lumber stack.
Figure 11:
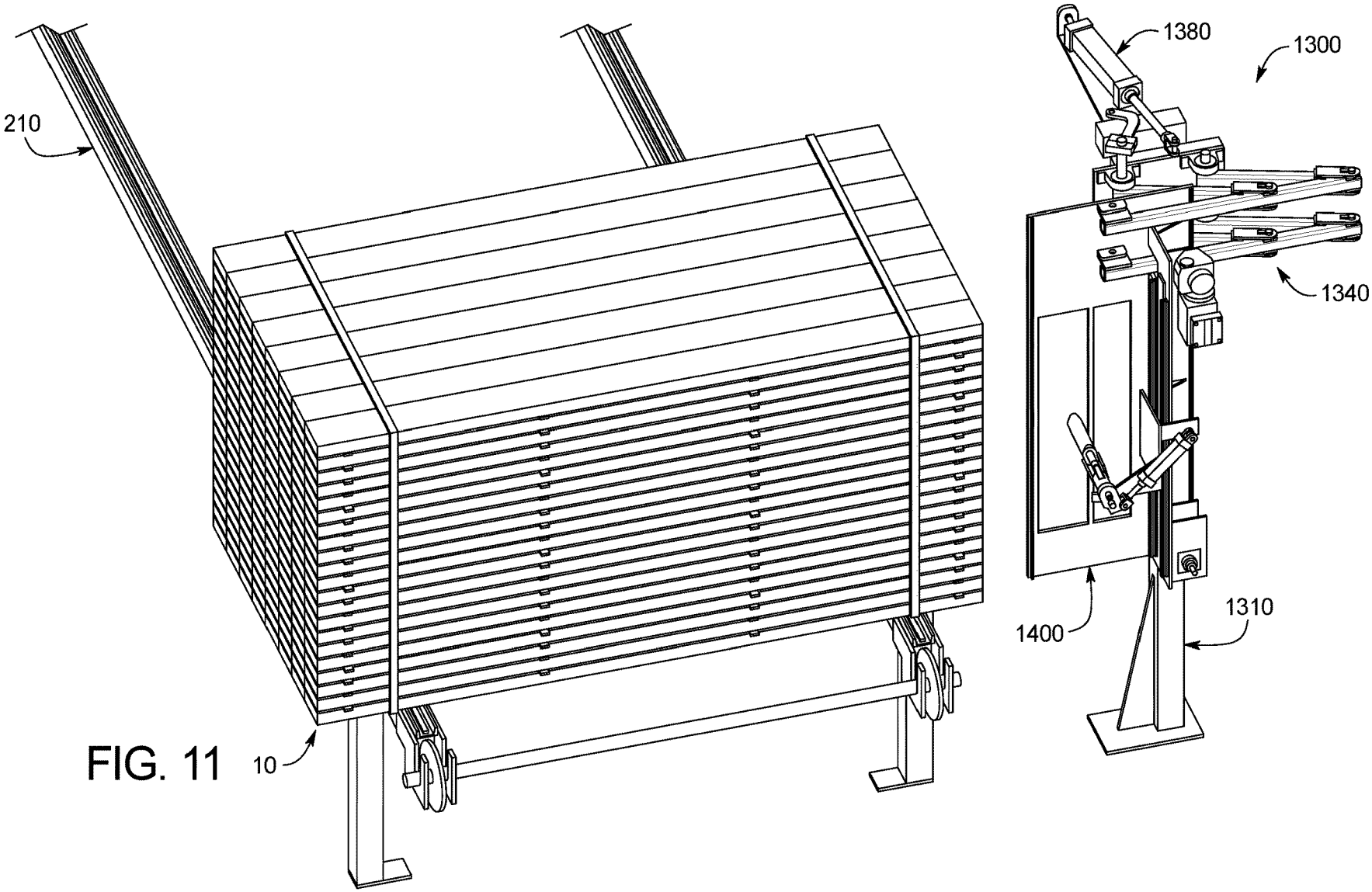
FIG. 11 is an enlarged diagrammatic perspective view of the lumber stack of FIG. 10 transversely positioned on and movable on the lumber stack conveyor apparatus of FIG. 10 (shown in fragmentary) and the lumber stack marking machine of FIG. 10 positioned adjacent to the lumber stack conveyor apparatus and configured to apply vertically extending markings of a marking set to a front side wall of the transversely positioned lumber stack.
Figure 12:
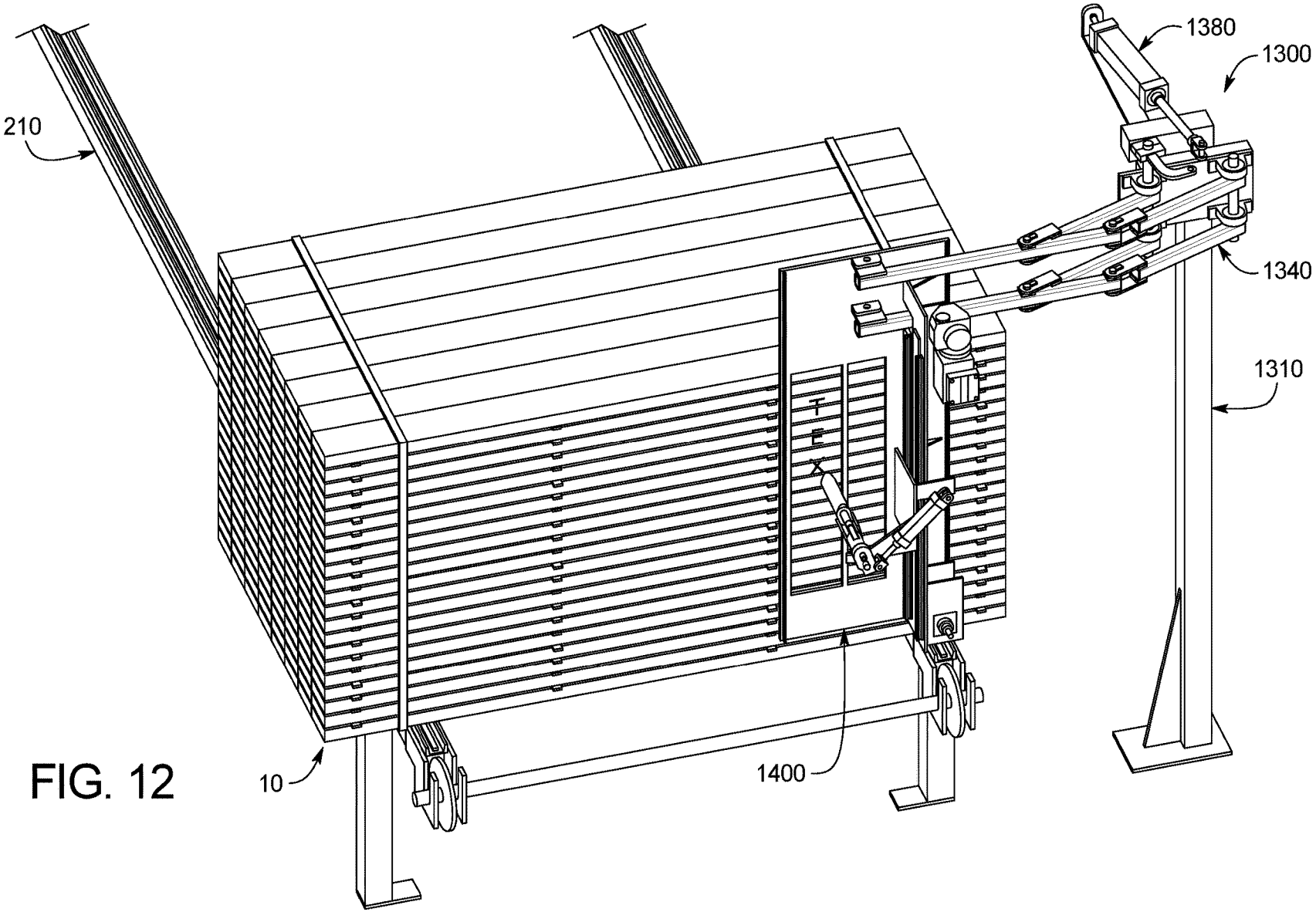
FIG. 12 is an enlarged diagrammatic perspective view of the lumber stack of FIG. 10 transversely positioned on and movable on the lumber stack conveyor apparatus of FIG. 10 (shown in fragmentary) and the lumber stack marking machine of FIG. 10 positioned adjacent to the lumber stack conveyor apparatus and applying vertically extending markings of a marking set to a front side wall of the transversely positioned lumber stack.

The methods of the present disclosure of applying one or more marking sets on an outer front or back wall of the lumber stack can also be employed when the lumber stack is transversely positioned on a conveyor and moves transversely on the conveyor the lumber stack. This longitudinal movement is generally illustrated in FIGS. 10, 11, and 12, in which: (1) the front and back walls 20 and 22 of the lumber stack 10 extend in a direction transverse to movement of the lumber stack on the conveyor; and (2) the end walls 24 and 26 of the lumber stack 10 extend in the direction of movement of the lumber stack on the conveyor.

Further alternative embodiments of the methods of the present disclosure apply one or more vertical marking sets using substantially the same steps as described above to one or more of the end walls of the lumber stack.

The methods of the present disclosure of applying one or more marking sets on an outer end wall of the lumber stack can be employed when the lumber stack is longitudinally positioned on a conveyor and moves longitudinally on the conveyor the lumber stack. This longitudinal movement is generally illustrated in FIGS. 5, 6, 7, and 8, in which: (1) the front and back walls 20 and 22 of the lumber stack 10 extend in the direction of movement of the lumber stack on the conveyor: and (2) the end walls 24 and 26 of the lumber stack 10 extend transverse to the direction of movement of the lumber stack on the conveyor.

Figure 13:
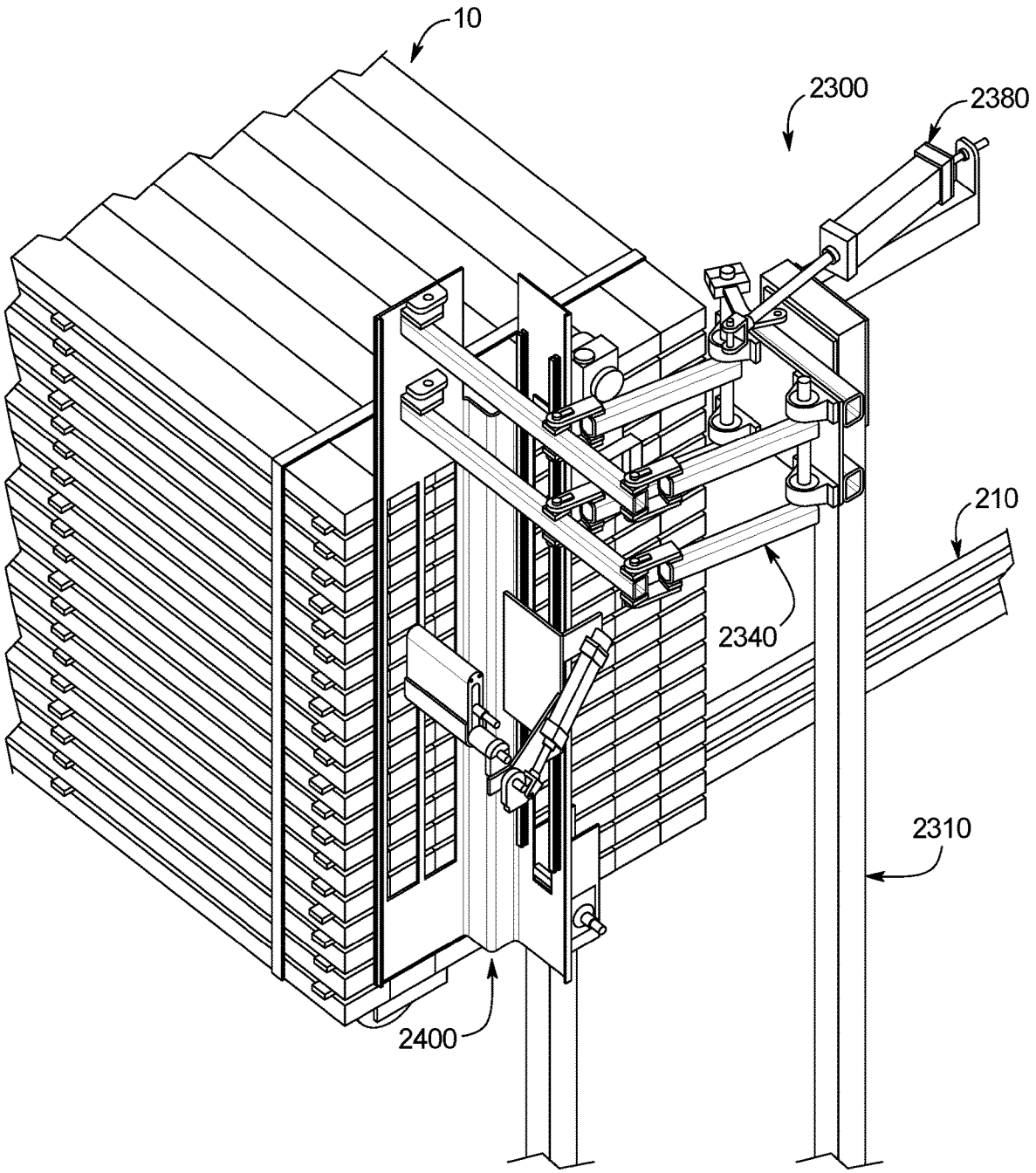
FIG. 13 is a diagrammatic perspective view of a lumber stack transversely positioned on and movable on a lumber stack conveyor apparatus (shown in fragmentary) and a further alternative example embodiment of the lumber stack marking machine of the present disclosure positioned adjacent to the lumber stack conveyor apparatus and configured to apply vertically extending markings of a marking set to an end wall of the transversely positioned lumber stack.

The methods of the present disclosure of applying one or more marking sets on an outer end wall of the lumber stack can also be employed when the lumber stack is transversely positioned on a conveyor and moves transversely on the conveyor the lumber stack. This longitudinal movement is generally illustrated in FIG. 13, in which: (1) the front and back walls 20 and 22 of the lumber stack 10 extend in a direction transverse to movement of the lumber stack on the conveyor; and (2) the end walls 24 and 26 of the lumber stack 10 extend in the direction of movement of the lumber stack on the conveyor.

These alternative methods of the present disclosure of applying one or more marking sets on an end wall of the lumber stack can thus be employed when: (1) the lumber stack is longitudinally positioned on a conveyor and moves longitudinally on the conveyor the lumber stack; or (2) the lumber stack is transversely positioned on a conveyor and moves transversely on the conveyor the lumber stack.

In various such embodiments of the present disclosure, the method includes moving a marking applicator assembly substantially horizontally from a rest position to a marking position for applying one or more vertical markings to an end wall of the lumber stack. This method then includes, for each desired vertical marking on the end wall of the lumber stack, moving part of a marking applicator assembly substantially vertically along the lumber stack and applying that marking to the lumber stack during this substantially vertical movement. This method then includes moving the marking applicator assembly substantially horizontally from the marking position to a rest position.

The above described methods of the present disclosure of applying one or more vertical marking sets on a lumber stack and specifically the individual markings of each of the vertical marking sets on the lumber stack include employing a marking head in the form of a spray head that is configured to apply the markings by applying (such as by spraying) ink on the lumber stack between the columns of stickers. The ink may be any suitable type of ink. The marking may also be formed from other suitable materials (besides ink) in accordance with the present disclosure.

Various methods of the present disclosure contemplate the individual markings are of substantially the same height and, in certain instances, substantially the same width. In alternative embodiments, two or more of the markings of the same marking set and/or different markings of different marking sets on a lumber stack are of different sizes.

The various methods of the present disclosure can be employed on lumber stack with different dimensions and with different sticker locations.

Example Lumber Stack Marking Machines

FIGS. 5, 6, 7, 8, and 9 generally illustrate one example embodiment of a lumber stack marking machine 300 of the present disclosure that is configured to apply two vertical marking sets to a side wall of a longitudinally positioned lumber stack such as lumber stack 10 in accordance with various methods of the present disclosure described above.

The lumber stack marking machine 300 is configured to be positioned adjacent to a lumber stack conveyor assembly (not fully shown) that includes a lumber stack conveyor such as lumber stack conveyor 210. The lumber stack conveyor assembly including the lumber stack conveyor is part of a lumber processing assembly line that produces lumber from logs as is well known to one of ordinary skill in the art. This well-known process generally includes, among other steps, cutting the logs into planks, trimming the planks into the desired lengths, examining the planks for quality, grade, and species, sorting the planks into bins, stacking the planks in each bin to form lumber stacks (with transversely extending stickers), strapping the lumber stacks, and drying the lumber stacks. The typical known lumber processing assembly line includes a lumber stack conveyor assembly in an area that has extremely limited space for extra equipment. The illustrated example lumber stack marking machine 300 is configured to fit in a relatively small space adjacent to this lumber stack conveyor.

This illustrated example lumber stack marking machine 300 generally includes: (1) a frame 310; (2) an arm assembly 340 connected to and supported by the frame 310; (3) an actuator assembly 380 connected to and supported by the frame 310 and operably connected to the arm assembly 340 to move the arm assembly 340 relative to the lumber stack (described below); (4) a marking applicator assembly 400 movably connected to and supported by the arm assembly 340; (5) a controller (not shown); and (6) one or more sensors (not shown). The controller is operatively connected to the actuator assembly 380 to cause the arm assembly 340 and the marking applicator assembly 400 to move between a rest position shown in FIG. 5 and a marking position shown in FIGS. 6, 7, and 8. When in the rest position, the lumber stack marking machine 300 does not interfere with: (1) the movement of the lumber stack 10 on the conveyor 210 to a stationary marking position adjacent to the lumber stack marking machine 300 for application of the vertical marking sets to the lumber stack 10; or (2) the movement of the lumber stack 10 on the conveyor 210 from the marking position after the lumber stack marking machine 300 applies the desired vertical marking sets to the lumber stack 10. In the marking position, the lumber stack marking machine 300 applies the desired vertical marking sets to the lumber stack on the conveyor 210.

In this illustrated embodiment, the lumber stack marking machine 300 and specifically the actuator assembly 380 moves the arm assembly 340 and the marking applicator assembly 400: (1) from the rest position toward the lumber stack 10 to the marking position between the stickers of the lumber stack 10; and (2) from the marking position away from the lumber stack to the rest position.

In this illustrated example embodiment, the frame 310 includes a plurality of supports 312, 314, and 316 configured to support the actuator assembly 380 and the arm assembly 340 (which in turn supports the marking applicator assembly 400). In this illustrated example embodiment, the frame 310 is suitably connected to the floor (not shown) adjacent to the lumber stack conveyor assembly and specifically adjacent to the lumber stack conveyor 210. In this illustrated example embodiment, the frame 310 is not connected to the lumber stack conveyor assembly. In alternative embodiments of the present disclosure, the frame is suitably connected (such as by interlocking) to the lumber stack conveyor assembly. The frame can include any suitable supports in accordance with the present disclosure.

In this illustrated example embodiment, the arm assembly 340 includes: (1) a first plurality of interconnected arms 342, 344, 346, and 348; (2) a second plurality of interconnected arms 352, 354, and 358; and (3) a plurality of linkages (not labeled) suitably connecting the first and second plurality of interconnected arms 342, 344, 346, 348, 352, 354, and 358 together, with the frame 310, and with the marking applicator assembly 400. The first plurality of interconnected arms 342, 344, 346, and 348 and the second plurality of interconnected arms 352, 354, and 358 are suitable connected by the plurality of linkages such that they all move together.

In this illustrated example embodiment, the actuator assembly 380 includes a pneumatic piston/rod assembly 390 including a piston 391 and a rod 392. Piston 391 includes opposite ends 391*a* and 391*b*. Rod 392 includes opposite ends 392*a* and 392*b*. End 392*a* of the rod 392 is pivotally attached to arm 346 and end 392*b* of the rod 392 is receivable in end 391*a* of the piston 391 in a conventional manner. End 391*b* is pivotally attached to frame member 316. The actuator assembly 380 is configured to, under control of the controller, actuate the piston/rod assembly 390 to move the arms of the arm assembly 340, and thus the marking applicator 400. More specifically, in this illustrated example embodiment, when the rod 392 moves outwardly, the rod 392 causes the arms of the arm assembly 340 to move from the resting position shown in FIG. 5 to the marking position shown in FIGS. 6, 7, and 8. Likewise, in this illustrated example embodiment, when the rod 392 moves inwardly, the rod 392 causes the arms of the arm assembly 340 to move from the marking position shown in FIGS. 6, 7, and 8 to the resting position shown in FIG. 5. The actuator assembly can be alternatively configured in accordance with the present disclosure and can includes suitable motors, solenoids, or other mechanisms instead of or in addition to the piston/rod assembly.

Figure 6:
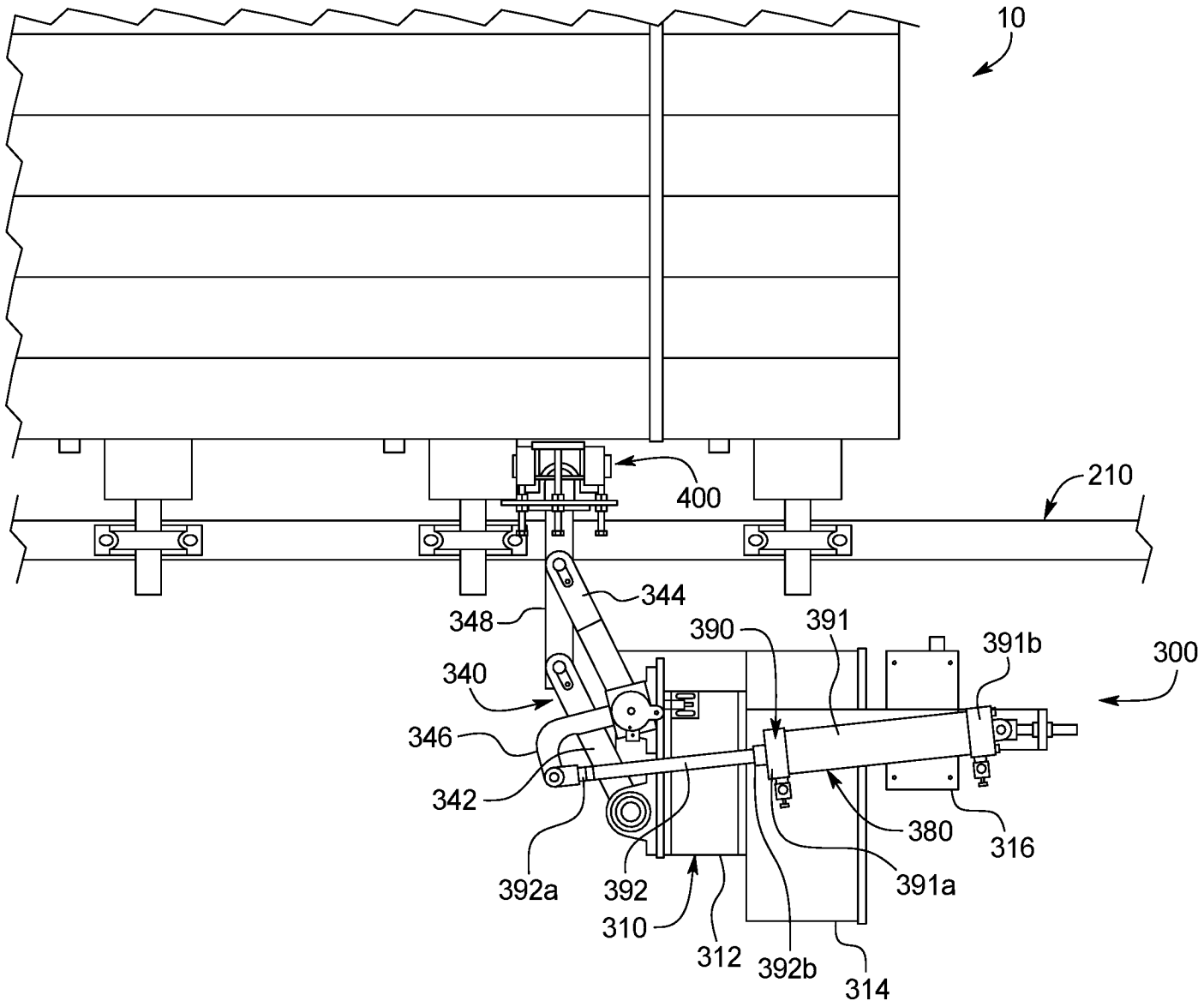
FIG. 6 is an enlarged top diagrammatic view of the lumber stack of FIG. 5 (shown in fragmentary) longitudinally positioned on and movable on the lumber stack conveyor apparatus of FIG. 5 (shown in fragmentary) and the lumber stack marking machine of FIG. 5 positioned adjacent to the lumber stack conveyor apparatus and positioned to apply vertically extending markings of a marking set to a front side wall of the lumber stack.
Figure 7:
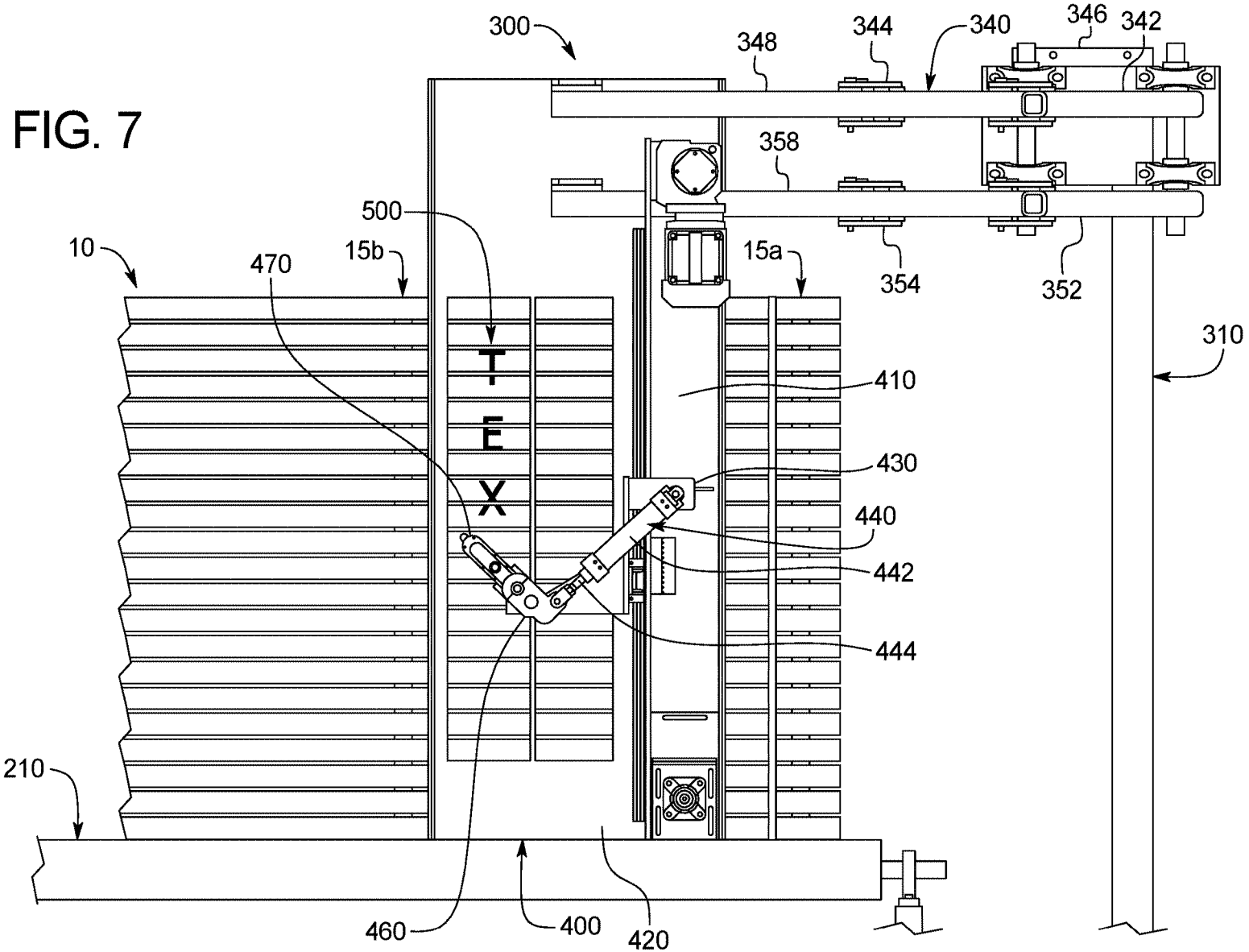
FIG. 7 is an enlarged diagrammatic side view of the lumber stack of FIG. 5 (shown in fragmentary) longitudinally positioned on and movable on the lumber stack conveyor apparatus of FIG. 5 (shown in fragmentary) and the lumber stack marking machine of FIG. 5 (shown in fragmentary) positioned adjacent to the lumber stack conveyor apparatus and applying first vertically extending markings of a first marking set to a front side wall of the lumber stack.
Figure 8:
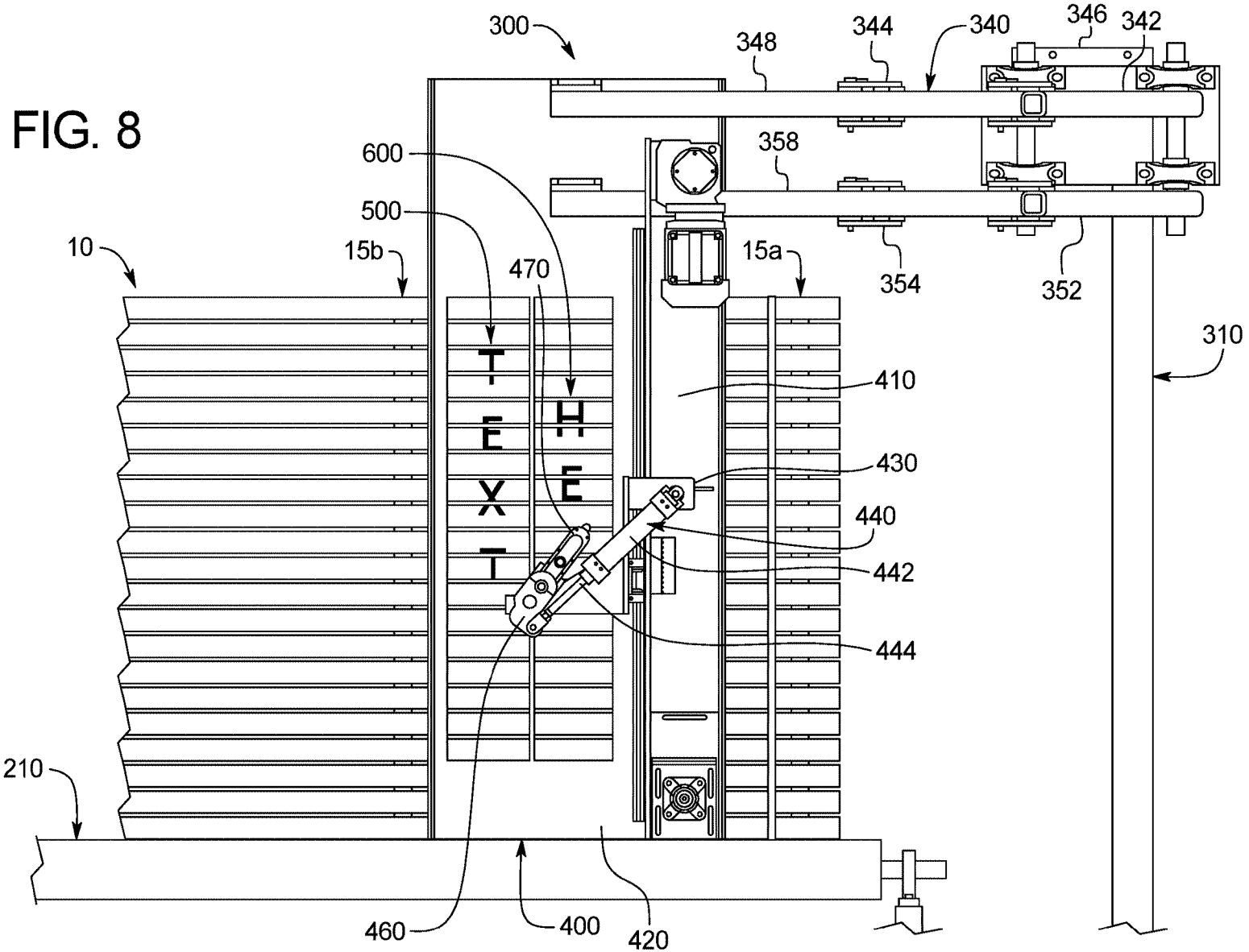
FIG. 8 is an enlarged diagrammatic side view of the lumber stack of FIG. 5 (shown in fragmentary) longitudinally positioned on and movable on the lumber stack conveyor apparatus of FIG. 5 (shown in fragmentary) and the lumber stack marking machine of FIG. 5 (shown in fragmentary) positioned adjacent to the lumber stack conveyor apparatus and applying second vertically extending markings of a second marking set to a front side wall of the lumber stack.
Figure 9:
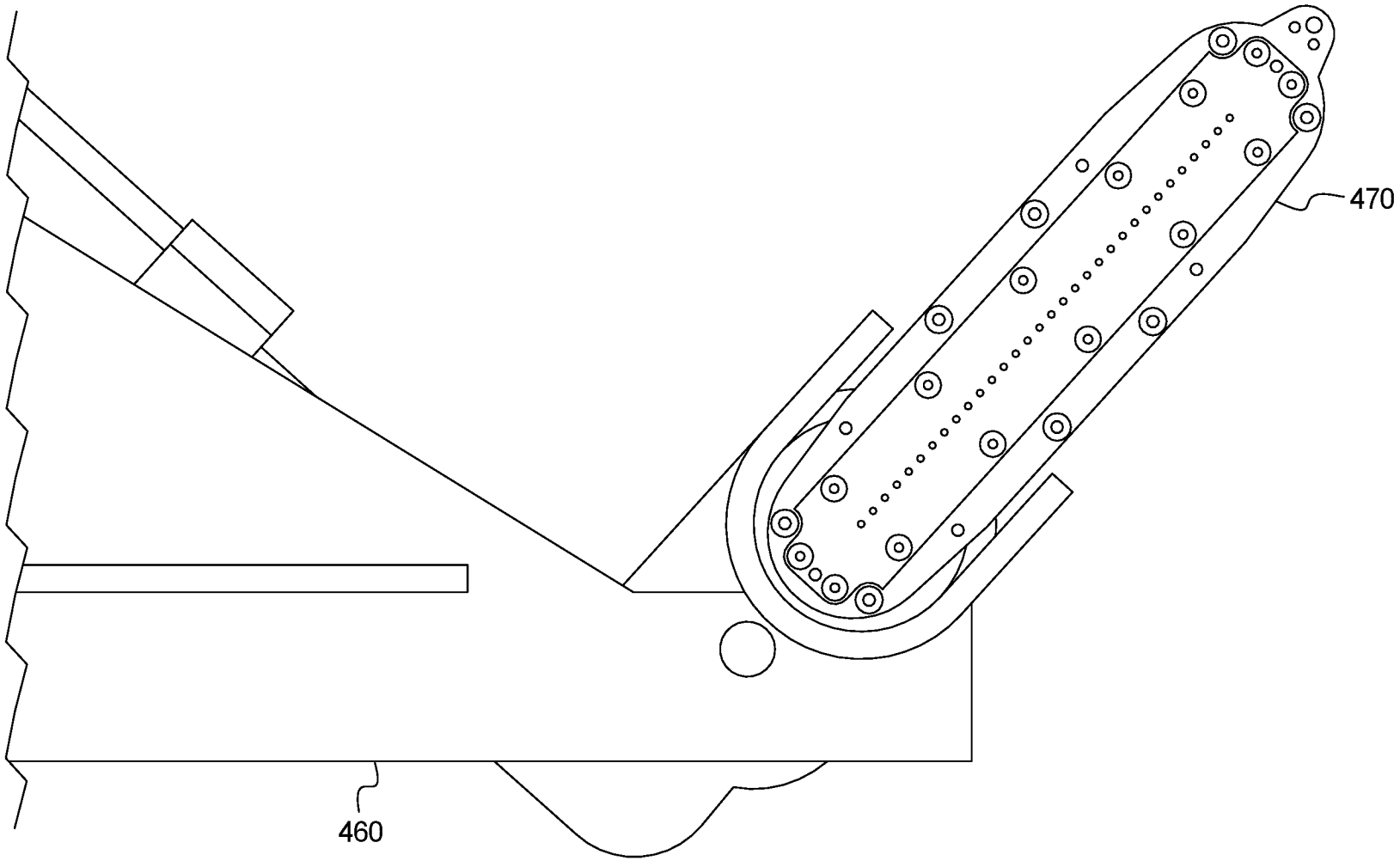
FIG. 9 is an enlarged diagrammatic front view of the marking head of the lumber stack vertical marking machine of FIG. 5, showing the front side of the marking head that faces the lumber stack.

In this illustrated example embodiment, the marking applicator assembly 400 includes: (1) a vertically extending carriage guide 410 connected to the arm assembly 340; (2) a carriage 430 movably connected to the carriage guide 410; (3) a vertically extending lumber stack engager 420 pivotally attached to the arm assembly 340; (4) a spray head arm 440 attached to the carriage 430; (5) a marking head in the form of spray head 470 pivotally connected to the spray head arm 440 and including an ink supplier. In this example embodiment, the marking head includes an ink jet system including a print head, and an ink delivery unit. In certain such embodiments, the ink delivery unit is replaceable. The arm assembly 340 is configured to move the marking applicator assembly 400 toward (such as horizontally toward) the lumber stack 10 such that the vertically extending lumber stack engager 420 engages a surface of the side wall of the lumber stack 10 between the stickers such as shown in FIGS. 6, 7, and 8. In various embodiments, the marking applicator assembly can include one or more sensors (communicatively connected to the controller) that provide confirmation of this engagement to the controller. In various embodiments, the force and speed at which the engager contacts the lumber stack is at least partially controlled by adjustments to the movements of the arm assembly 340 by the actuator assembly 380.

In certain embodiments, the vertically extending lumber stack engager 420 is configured to laterally and vertically to adapt to varying positions of the stopped lumber stack, especially when the lumber stack is not positioned perfectly on the conveyor relative to the marking application 400. For example, the lumber stack can shift or not be perfectly straight vertically due to handling, stacking, or other process variations. In various embodiments, the lumber stack engager 420 can be configured to accommodate such offset positions of the lumber stack. In certain such embodiments, the marking applicator assembly 400 can includes one or more adjustment arms that adjust the pitch of the lumber stack engager. In various embodiments, the marking applicator assembly can adjust the size of the letters to account for such lumber stack variations.

The carriage 430 is connected to and moveable vertically on the carriage guide 410 to, under the control of the controller, vertically move the spray head arm 440 and the spray head 470 to the desired starting position for each marking to be applied to the lumber stack 10 and during the application of each marking to the lumber stack 10. In certain embodiments, the carriage 340 is belt driven by a suitable motor (not shown) operatively connected to the belt. In certain embodiments, the motor is controlled by a variable frequency drive to provide smooth starts, stops, and speed adjustments.

The spray head 470 is in fluid communication with the paint supplier and operates under the control of the controller. The spray head 470 in this illustrated example embodiment includes multiple spray nozzles (not labeled) and is configured to be positioned adjacent to an outer wall of the lumber stack to apply each of the markings of each marking set to the outer wall of the lumber stack. The spray head arm 440 is configured to pivot the spray head 470 between two spraying positions separated by about a substantially ninety degree angle and respectively shown in FIGS. 7 and 8. In this illustrated example embodiment, the spray head arm 440 includes a pneumatic piston/rod assembly including a piston 442 and a rod 444. Piston 442 includes opposite ends (not labeled). Rod 444 includes opposite ends (not labeled). One end of the rod 444 is pivotally attached to the spay head 470 and the opposite end of the rod 444 is receivable in one end of the piston 442 in a conventional manner. The opposite end of the piston is pivotally attached to carriage 430. The marking applicator 400 is configured to, under control of the controller, actuate the piston/rod assembly to move the spray head 470. More specifically, in this illustrated example embodiment, when the rod 444 moves outwardly, the rod 444 causes the spray head 470 to pivot toward the carriage 430 as shown in FIG. 8. When the rod 444 moves inwardly, the rod 444 causes the spray head 470 to pivot away from the carriage 430 as shown in FIG. 7. This configuration enables the spray head 470 to apply the two adjacent but spaced apart vertically extending markings 500 and 600 to the lumber stack 10 between the stickers with a single pivot of the spray head. The spray head 470 is shown in a first angled position in FIG. 7 and is shown moved (such as pivoted) to a second angled position in FIG. 8, In this illustrated example embodiment, marking set 500 includes the vertically arranged markings "T E X T" and marking set 600 includes the vertically arranged marking "H E R E". FIG. 8 shows the spraying head 470 in the process of applying the marking set 600, In certain embodiments, the print head is stationary when it applies each marking (i.e., it does not move when it applies a single marking, but is moved after applying that marking to a position for applying a subsequent marking). In certain embodiments, the marking applicator 400 can include one or more sensors that determine and/or verify the position of the spray head arm 440 and/or the spray head 470 before applying the vertically arranged markings of each of the marking sets.

The controller is communicatively connected to each of the sensors to receive signals from the sensors and is operatively connected to the actuator assembly 380 and the marking applicator 400 to control the actuator assembly 380 and the marking applicator assembly 400 based in part on signals received from the sensor(s). The controller is also configured to communicate with and operate with one or more programmable logic controllers (PLC) that control part or all of the operation of the lumber processing assembly line and specifically the conveyor assembly thereof. In various embodiments, the controller and PLC are configured to co-act to: (1) stop the conveyor 210 to position the lumber stack 10 to be marked adjacent to the lumber stack marking machine 300 for application of the vertical marking sets to the lumber stack; (2) send and receive the appropriate signals that the conveyor 210 has stopped and positioned the lumber stack 10 to be marked adjacent to the lumber stack marking machine 300 for application of the vertical marking sets to the lumber stack; and (3) to restart movement of the conveyor 210 to move the lumber stack 10 after the vertical marking sets have been applied to the lumber stack 10. The controller is also configured to: (1) cause the horizontal movement of the arm assembly 340 to position the lumber stack engager 420 and the marking applicator assembly 400 relative to the side wall the lumber stack 10; (2) cause the vertical movement of the carriage 400, the spray head arm 440, and the spray head 470 to position the spray head 470 relative to the side wall the lumber stack; and (3) cause the spray head 470 to pivot relative to the side wall the lumber stack 10.

FIGS. 10, 11, and 12 generally illustrate a lumber stack marking machine 1300 of another example embodiment of the present disclosure that is configured to apply vertical marking sets to a side wall of a lumber stack positioned transversely on a conveyor in accordance with various methods of the present disclosure described above.

The lumber stack marking machine 1300 is configured to be positioned adjacent to a lumber stack conveyor assembly (not fully shown) that includes a lumber stack conveyor 210. The lumber stack conveyor assembly (including the lumber stack conveyor 210) is part of a lumber processing assembly line that produces lumber from logs. This illustrated example lumber stack marking machine 1300 is configured to fit in a relatively small space adjacent to the lumber stack conveyor 210.

This illustrated example lumber stack marking machine 1300 generally includes: (1) a frame 1310; (2) an arm assembly 1340 connected to and supported by the frame 1310; (3) an actuator assembly 1380 connected to and supported by the frame 1310 and connected to the arm assembly 1340; (4) a marking applicator assembly 1400 movably connected to and supported by the arm assembly 1340; (5) a controller (not shown); and (6) one or more sensors (not shown). The frame 1310, arm assembly 1340, the actuator assembly 1380, the marking applicator assembly 1400, the controller, and the sensors of the lumber stack marking machine 1300 are substantially the same as the frame 310, arm assembly 340, the actuator assembly 380, the marking applicator assembly 400, the controller, and the sensors of the lumber stack marking machine 300 except that the arm assembly 1340 is alternatively configured for the desired movement of the arm assembly and the applicator assembly 1400.

The actuator assembly 1380 is configured to, under control of the controller, cause the arm assembly 1340 and the marking applicator assembly 1400 to move from a rest position shown in FIGS. 10 and 11 to a marking position shown in FIG. 12, and back to the rest position. In the rest position, the lumber stack marking machine 1300 does not interfere with: (1) the movement of the lumber stack 10 on the conveyor 210 to a stationary marking position adjacent to the lumber stack marking machine 1300 for application of the vertical marking(s) to the lumber stack 10; or (2) the movement of the lumber stack 10 on the conveyor 210 from the marking position after the lumber stack marking machine 1300 applies the desired vertical marking(s) to the surface of the side wall of the lumber stack 10. In the marking position, the lumber stack marking machine 300 applies a desired quantity of vertical marking sets to the side wall of the lumber stack 10 on the conveyor 210.

In this illustrated embodiment, the lumber stack marking machine 1300 and specifically the actuator assembly moves the arm assembly 1340 and the marking applicator assembly 1400: (1) substantially horizontally from the rest position to a marking position between the stickers of the lumber stack 10; and (2) substantially horizontally from the marking position to the rest position.

FIG. 13 generally illustrates a lumber stack marking machine 2300 of another example embodiment of the present disclosure that is configured to apply vertical markings to an end wall of a transversely positioned lumber stack in accordance with various methods of the present disclosure described above.

The lumber stack marking machine 2300 is configured to be positioned adjacent to a lumber stack conveyor assembly (not fully shown) that includes a lumber stack conveyor such as lumber stack conveyor 210. The lumber stack conveyor assembly (including the lumber stack conveyor) is part of a lumber processing assembly line that produces lumber from logs. This illustrated example lumber stack marking machine 2300 is configured to fit in a relatively small space adjacent to this lumber stack conveyor 210.

This illustrated example lumber stack marking machine 2300 generally includes: (1) a frame 2310; (2) an arm assembly 2340 connected to and supported by the frame 2310; (3) an actuator assembly 2380 connected to and supported by the frame 2310 and connected to the arm assembly 2340; (4) a marking applicator assembly 2400 movably connected to and supported by the arm assembly 2340; (5) a controller (not shown); and (6) one or more sensors (not shown). The frame 2310, arm assembly 2340, the actuator assembly 2380, the marking applicator assembly 2400, the controller, and the sensors of the lumber stack marking machine 2300 are substantially the same as the frame 310, arm assembly 340, the actuator assembly 380, the marking applicator assembly 400, the controller, and the sensors of the lumber stack marking machine 300 except that the arm assembly 2340 is alternatively configured for the desired movement of the arm assembly and the applicator assembly 1400.

The actuator assembly 2380 is configured to, under control of the controlling cause the arm assembly 2340 and the marking applicator assembly 2400 from a rest position (not shown) to a marking position shown in FIG. 13, and back to the rest position. The actuator assembly 2380 is configured to cause the arm assembly 2340 and the marking applicator assembly 2400 to move from a rest position to a marking position shown in FIG. 13 and back to the rest position, all under the control of the controller. In the rest position, the lumber stack marking machine 2300 does not interfere with: (1) the transverse movement of the lumber stack 10 on the conveyor 2210 to a stationary marking position adjacent to the lumber stack marking machine 2300 for application of the vertical marking(s) to the lumber stack 10; and (2) the transverse movement of the lumber stack 10 on the conveyor 2210 from the marking position after the lumber stack marking machine 2300 applies the desired vertical marking sets to the lumber stack 10. In the marking position, the lumber stack marking machine 2300 applies a desired quantity of vertical marking sets to the end wall of the lumber stack 10 on the conveyor 2210.

In this illustrated embodiment, the lumber stack marking machine 2300 and specifically the actuator assembly moves the arm assembly 1340 and the marking applicator assembly 2400: (1) substantially horizontally from the rest position to a marking position adjacent to an end wall of the lumber stack 10 as shown in FIG. 13; and (2) substantially horizontally from the marking position to the rest position (not shown).

In alternative embodiments which are not shown, the same lumber stack marking machine can be configured to move to apply vertical marking to both a side wall of the lumber stack and to an end wall of the lumber stack. In certain such embodiments, one or more additional pivot points may be added to the arm assembly to accomplish the desired positioning of the arm assembly and the applicator assembly.

These example lumber stack marking machines are meant to be non-limiting examples of the lumber stack marking machines provided by the present disclosure.

The present disclosure provides several advantages over known methods, systems, and apparatus for applying markings to lumber stacks. These advantages include but are not limited to facilitating application of high quality marking set on: (1) lumber stacks regardless sticker locating and the lengths that the stickers extend from the side walls of the lumber stack; (2) side or end walls of a lumber stack; and (3) narrow end walls of a lumber stack. These advantages further include: (4) facilitating multiple vertical columns of markings of marking sets with a simple single pivot of the spray head (without the need for complicated and expensive equipment; (5) facilitating different height markings (such as markings of 4", 5", 6", 8" and 10" heights) with the same spray head; and (6) facilitating the ability to print on the lumber stack when the lumber stack is arranged in linear or transverse configurations or positions.

In various embodiments, only one lumber stack marking machine of the present disclosure is employed to apply one or more marking sets to each lumber stacks. In other various embodiments, more than one lumber stack marking machine of the present disclosure is employed to apply more than one marking sets to each lumber stacks (such as on opposite sides of the lumber stack).

Thus, various embodiments of the present disclosure provide a method of applying a vertical marking set to a lumber stack, the method comprising: moving the lumber stack adjacent to a lumber stack marking machine; moving a marking applicator assembly of the lumber stack marking machine relative to the lumber stack from a rest position to a marking position; applying, by the marking applicator assembly, a first marking and a second marking of the vertical marking set to an outer wall of the lumber stack, wherein the second marking is below the first marking; and moving the marking applicator assembly from the marking position to the rest position.

In various such embodiments, the outer wall of the lumber stack comprises a side wall of the lumber stack, and wherein moving the marking applicator to the marking position comprises moving the marking applicator assembly between two columns of stickers of the lumber stack.

In various such embodiments, the outer wall of the lumber stack comprises an end wall.

In various such embodiments, applying each marking to the outer wall of the lumber stack comprises vertically moving a marking head of the marking applicator relative to the outer wall of the lumber stack.

In various such embodiments, the method comprises applying two laterally spaced apart vertical marking sets to the outer wall of the lumber stack.

In various such embodiments, the method comprises pivoting a marking head from a first position to a second position after applying the first of the two vertical marking sets to the outer wall of the lumber stack.

In various such embodiments, applying each vertical marking set to the outer wall of the lumber stack comprises vertically moving a marking head of the marking applicator relative to the outer wall of the lumber stack.

In various such embodiments, the first and second markings are positioned relative to one another such that the first and second markings both intersect a substantially vertical axis.

In various such embodiments, the first marking is at least partially below a bottom of the second marking.

In various such embodiments, the first marking is entirely below the second marking.

In various such embodiments, the first and second markings are positioned relative to one another such that no horizontal line that passes through the first marking intersects any horizontal line passing through the second marking.

Various other embodiments of the present disclosure provide a lumber stack marking machine comprising: a frame; an arm assembly connected to the frame; an actuator assembly connected to the frame and operatively connected to the arm assembly to move the arm assembly; a marking applicator assembly connected to the arm assembly; and a controller operatively connected to the actuator assembly to control the actuator assembly to move the arm assembly and the marking applicator assembly from a rest position to a marking position and to control the marking applicator to, when in the marking position, apply a first marking of a marking set to an outer wall of the lumber stack and apply a second marking of the marking set to the outer wall of the lumber stack below the first marking.

In various such embodiments, the actuator assembly operatively connected to the arm assembly to move the arm assembly and the marking applicator assembly substantially horizontally between the rest position and the marking position.

In various such embodiments, the marking applicator assembly comprises: (1) a carriage guide; (2) a carriage movably connected to the carriage guide; (3) a lumber stack engager; (4) a spray head arm attached to the carriage; and (5) a spray head connected to the spray head arm.

In various such embodiments, the spray head is connected to the spray head arm and configured to pivot between two different positions.

Various changes and modifications to the presently preferred embodiments described herein will be apparent to those skilled in the art. These changes and modifications can be made without departing from the spirit and scope of the present subject matter and without diminishing its intended advantages. It is intended that such changes and modifications be covered by the appended claims.

The invention claimed is:

1. A lumber stack marking machine comprising:

a frame;

an arm assembly connected to the frame;

an actuator assembly connected to the frame and operatively connected to the arm assembly to move the arm assembly;

a marking applicator assembly connected to the arm assembly and comprising: a carriage guide; a carriage movably connected to the carriage guide; a lumber stack engager; a spray head arm attached to the carriage; and a spray head connected to the spray head arm; and a controller operatively connected to the actuator assembly and configured to:

control the actuator assembly to move the arm assembly and the marking applicator assembly from a rest position to a marking position adjacent a lumber stack, wherein the lumber stack comprises a first row of a first plurality of pieces of lumber, a second row of a second plurality of pieces of lumber, a third row of a third plurality of pieces of lumber, and a fourth row of a fourth plurality of pieces of lumber, wherein the first row is above the second row, the second row is above the third row, and the third row is above the fourth row;

control the spray head to apply a first marking of a vertical marking set to one of the pieces of lumber of the first row and one of the pieces of lumber of the second row;

control the actuator assembly to move the marking applicator assembly downward; and control the spray head to apply a second marking of the vertical marking set to one of the pieces of lumber of the third row and one of the pieces of lumber of the fourth row.

2. The lumber stack marking machine of claim 1, wherein the controller is configured to control the spray head to apply the second marking to the piece of lumber of the third row and the piece of lumber of the fourth row such that the second marking extends from that piece of lumber of the third row to that piece of lumber of the fourth row.

3. The lumber stack marking machine of claim 1, wherein the actuator assembly is operatively connected to the arm assembly and configured to move the arm assembly and the marking applicator assembly substantially horizontally between the rest position and the marking position.

4. The lumber stack marking machine of claim 3, wherein the spray head is configured to pivot between two different positions.

5. The lumber stack marking machine of claim 4, wherein the spray head arm comprises a pneumatic piston/rod assembly comprising a piston connected to the carriage and a rod having one end received in the piston and another end connected to the spray head, wherein the controller is configured to control the pneumatic piston/rod assembly to extend the rod from the piston to pivot the spray head from a first of the positions to a second of the positions and to retract the rod into the piston to pivot the spray head from the second of the positions to the first of the positions.

6. The lumber stack marking machine of claim 1, wherein the controller is further configured to control the actuator assembly to move the arm assembly and the marking applicator assembly from the rest position to the marking position such that the lumber stack engager engages a surface of a side wall of the lumber stack.

7. The lumber stack marking machine of claim 1, wherein the lumber stack engager defines an opening therethrough, wherein the spray head is positioned adjacent the opening while the controller controls the spray head to apply the first and second markings to the pieces of lumber.

8. The lumber stack marking machine of claim 1, wherein the actuator assembly comprises a pneumatic piston/rod assembly comprising a piston connected to the frame and a rod having one end received in the piston and another end connected to the arm assembly, wherein the controller is configured to control the actuator assembly to move the arm assembly and the marking applicator assembly from the rest position to the marking position by controlling the pneumatic piston/rod assembly to extend the rod from the piston.

* * * * *